US008740458B2

(12) United States Patent
Edwards et al.

(10) Patent No.: US 8,740,458 B2
(45) Date of Patent: Jun. 3, 2014

(54) EASY OPEN BAG

(75) Inventors: Eduard Edwards, Arlington, TX (US); Joseph Paul Sagel, Plano, TX (US)

(73) Assignee: Frito-Lay North America, Inc., Plano, TX (US)

( * ) Notice: Subject to any disclaimer, the term of this patent is extended or adjusted under 35 U.S.C. 154(b) by 290 days.

(21) Appl. No.: 12/787,027

(22) Filed: May 25, 2010

(65) Prior Publication Data

US 2011/0293207 A1 Dec. 1, 2011

(51) Int. Cl.
*B65D 33/00* (2006.01)
*B65D 30/08* (2006.01)

(52) U.S. Cl.
USPC ..... 383/207; 383/201; 383/209; 383/109

(58) Field of Classification Search
USPC ..... 383/200, 201, 207, 208, 209, 109
See application file for complete search history.

(56) References Cited

U.S. PATENT DOCUMENTS

| | | | | |
|---|---|---|---|---|
| 3,146,912 | A | 9/1964 | Twersky | |
| 4,200,416 | A | 4/1980 | Kezran | |
| 4,332,327 | A | 6/1982 | Frohwerk | |
| 5,964,688 | A | 10/1999 | Woody | |
| 5,984,088 | A * | 11/1999 | Dietz et al. | 206/205 |
| 6,422,986 | B1 | 7/2002 | Claybaker | |
| 6,871,476 | B2 | 3/2005 | Tobolka | |
| 7,971,717 | B2 * | 7/2011 | Eilert et al. | 206/391 |
| 2004/0011007 | A1 | 1/2004 | Kohl | |
| 2007/0023425 | A1 | 2/2007 | Kanzaki | |
| 2007/0297702 | A1 * | 12/2007 | Zaggia et al. | 383/200 |
| 2008/0063324 | A1 * | 3/2008 | Bernard et al. | 383/200 |
| 2009/0049800 | A1 | 2/2009 | Sadler | |
| 2010/0111453 | A1 | 5/2010 | Dierl | |

FOREIGN PATENT DOCUMENTS

| | | | | |
|---|---|---|---|---|
| FR | 2771718 | A1 * | 6/1999 | B65D 77/30 |
| JP | 08164949 | A * | 6/1996 | B65D 33/00 |
| JP | 09207950 | A * | 8/1997 | B65D 33/38 |
| JP | 10119984 | A * | 5/1998 | B65D 33/00 |
| JP | 2000281090 | A * | 10/2000 | B65D 33/38 |
| JP | 2001348042 | A * | 12/2001 | B65D 33/08 |
| JP | 2002224994 | A * | 8/2002 | B26D 3/00 |
| JP | 2005193953 | A * | 7/2005 | B65D 75/62 |
| JP | 2006273338 | A | 10/2006 | |
| JP | 2008074464 | A * | 4/2008 | |
| JP | 2008179393 | A | 8/2008 | |

OTHER PUBLICATIONS

Machine translation of French Document No. 2771718. Translated on Aug. 22, 2012.*
Machine translation of Japanese Document No. 2008-74464. Translated on Jul. 24, 2013.*

* cited by examiner

*Primary Examiner* — Jes F Pascua
(74) *Attorney, Agent, or Firm* — Shaukat A. Karjeker; Colin P. Cahoon; Carstens & Cahoon, LLP

(57) ABSTRACT

An easy open bag and method for making the same. A film is fed into a jaw assembly comprising a first seal jaw comprising a blade gap and a second seal jaw comprising a removable insert. The removable insert comprises a blade pin. When the first and second seal jaws are mated, a notch is formed. The film also comprises a score line in the outer layer. Upon tearing the notch the tear propagates along the score line. Thus, the package can be easily opened by initiating a tear at a tear notch.

13 Claims, 6 Drawing Sheets

EASY OPEN BAG

BACKGROUND OF THE INVENTION

1. Technical Field

The present invention relates to an easy to open package and method for making the same.

2. Description of Related Art

Snack foods and other items are often packaged in bags formed from thin, flexible packaging films. These thin films are formed primarily of plastics, such as polypropylene and polyethylene, but can also contain metalized films, foil, paper, or oriented films. These packaging films can have numerous layers directed to achieving specific needs, but are generally formed at least in part by extrusion of a plastic layer, co-extrusion of multiple layers simultaneously, extrusion coating of another material (such as paper), and the lamination of two layers together via either extrusion lamination or adhesive lamination. In the discussions below, both extrusion lamination and adhesive lamination processes are discussed in more detail, but it is noted that any designated layer that is fed into these two processes can already be a multi-layer film formed by any of the above processes.

An exemplary film 100 for packaging of food products is seen in FIG. 1. The outermost layer 102 is an OPP layer, short for oriented polypropylene, while the innermost layer 106 is a metalized OPP or other barrier material. An oriented polymer material has been specially treated so that the long polymeric molecules tend to align in a given direction, causing the material to preferentially tear in that direction. Sandwiched between the two OPP layers 102, 106 is an adhesive such as polyethylene 104 or other adhesive. Printing for the package is done on the inside of the outer layer and becomes sandwiched between the middle and outer layers. The innermost, metallic layer 106 can itself be a layered laminate and contains a sealant layer 108 on what will be the inside, or product side, of the package. This sealant layer 108 is typically formed of a ter-polymer, composed of ethylene, propylene, and butylenes, along with the metallic layers, and provides a barrier to retain taste and freshness of the product contained therein. Other materials used in packaging are polyester, paper, polyolefin extrusions, adhesive laminates, and other such materials, or a layered combination of the above.

Once the material is formed and cut into desired widths, it can be loaded into a vertical form, fill, and seal machine to be used in packaging the many products that are packaged using this method. FIG. 2 shows an exemplary vertical form, fill, and seal machine that can be used to package snack foods, such as chips. This drawing is simplified and does not show the cabinet and support structures that typically surround such a machine, but it demonstrates the working of the machine. Packaging film 210 is taken from a roll 212 of film and passed through tensioners 214 that keep it taut. The film then passes over a former 216 which directs the film as it forms a vertical tube around a product delivery cylinder 218. This product delivery cylinder 218 normally has either a round or a somewhat oval cross-section. As the tube of packaging material is pulled downward by drive belts 220, the edges of the film are sealed along its length by a vertical sealer 222, forming a back seal 224. The machine then applies a pair of heat-sealing jaws 226 and accompanying jaw face 233 against the tube to form a transverse seal 228. Different shapes of jaw faces 233 result in different shaped seals. The transverse seal 228 acts as the top seal on the bag 230 below the sealing jaws 226 and the bottom seal on the bag 232 being filled and formed above the jaws 226. After the transverse seal 228 has been formed, a cut is made across the sealed area to separate the finished bag 230 below the seal 228 from the partially completed bag 232 above the seal. The film tube is then pushed downward to draw out another package length. Before the sealing jaws form each transverse seal, the product to be packaged is dropped through the product delivery cylinder 218 and is held within the tube above the transverse seal 228.

Although there is no one perfect package for all uses, there are a number of desirable features that manufacturers strive for in packages. One such feature is the ability to easily open the package. Consumers now must grip the package with both hands, pinch each side of the package between the thumb and fingers of each hand, and pull with sufficient force to break the seal. This can become more difficult as a consumer gets older. For example, some consumers have arthritis or have lost strength in their hands. Grasping the sides of a flexible bag and opening it as previously described may be a difficult task for them. Therefore, it is desirable to have a bag that is easier to open by hand than is available from the prior art.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicants' invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 3B:
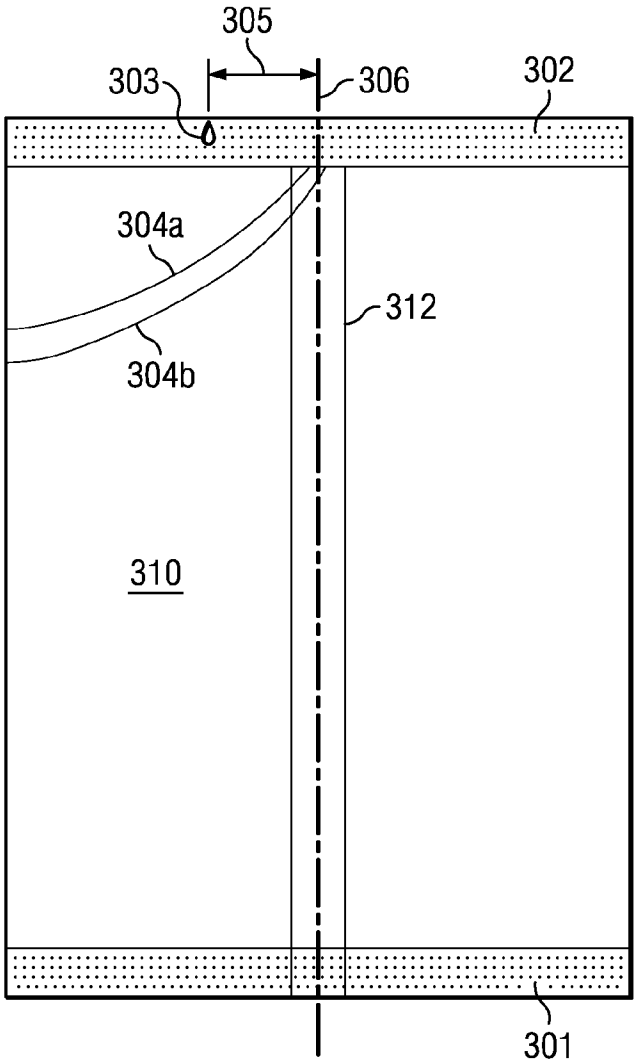
FIG. 3*b* depicts a back planar view of a package in one embodiment.
Figure 3A:
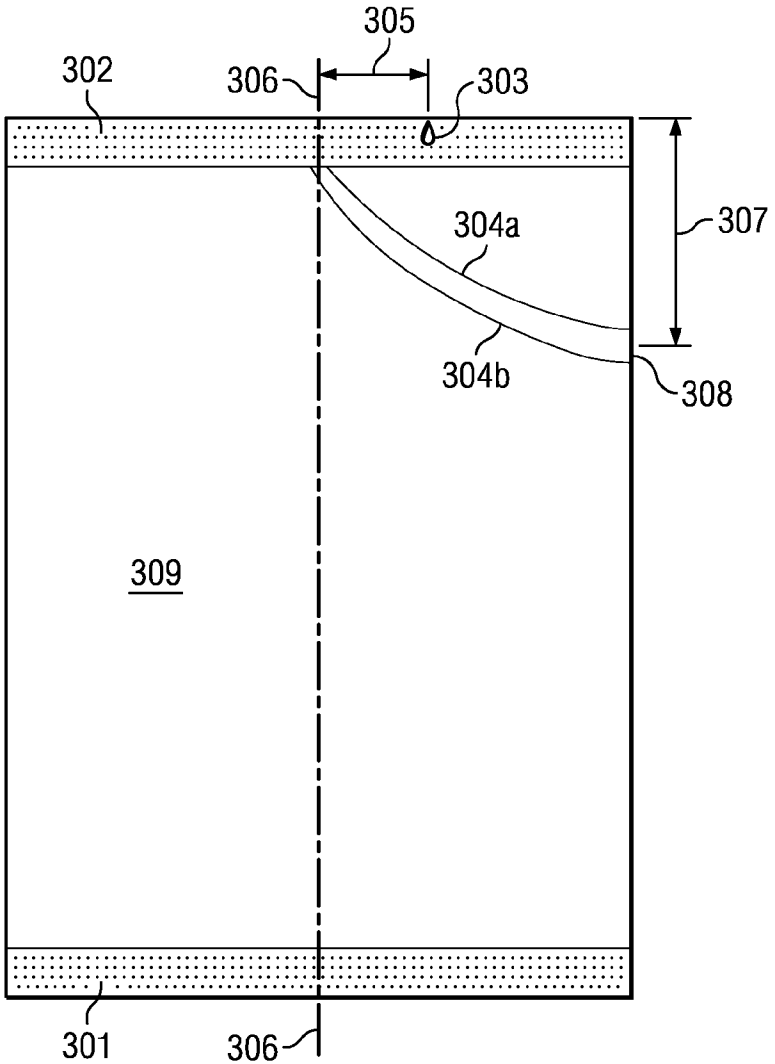
FIG. 3*a* depicts a top planar view of a package in one embodiment.

FIG. 3*a* depicts a top planar view of a package in one embodiment. As depicted the package comprises a flexible film web, and in some embodiments comprises an oriented film such as an oriented polymer material. As used herein a flexible film web is a web comprising at least two flexible layers. An oriented polymer material is a polymer material which has been specially treated so that the long polymeric molecules tend to align in a given direction, causing the material to preferentially tear in that direction. In the embodiment depicted, the package is oriented so that it preferentially tears along its vertical axis. The package comprises a top seal 302, a bottom seal 301, and a front panel 309. The front panel 309 is defined as being between the bottom and top seal. The front panel 309 has a left and a right side.

FIG. 3*b* depicts a back planar view of one embodiment of a package in the instant invention. FIG. 3*b* shows the top seal 302, a bottom seal 301, and a back panel 310. The back panel 310 is contiguous with the front panel and is defined as between the bottom seal and top seal. FIG. 3*b* also illustrates the back seal 312. As depicted the back seal 312 runs vertically between the top 302 and bottom 301 seals in the middle of the back panel of the package. However, the back seal 308 can be located at virtually any location on the package, including the front panel 309. Further, in some embodiments such as a stand-up package, the back seal 308 is oriented in the horizontal direction when the package is standing upright.

In one embodiment the front panel 309 and/or the back panel 310 comprises graphics. The graphics can comprise any graphics known in the art. In one embodiment the front panel 309 and/or the back panel 310 comprises graphics which are readable when the top 302 and bottom 301 seals are parallel to a horizontal plane. Thus, if the package is sitting upon its bottom seal 301 the graphics are readable. As an example, if the graphics comprise words, in one embodiment the words are oriented to be readable when the package is sitting upon its bottom seal 301. In one embodiment the words are parallel to a horizontal plane. In another embodiment the graphics are readable when the top 302 and bottom 301 seals are perpendicular to a horizontal plane. In one embodiment the graphics are readable when the package sits upon its left edge. In another embodiment the graphics are readable when the package rests on its right edge. In one embodiment wherein the package rests upon its left edge so that the top 302 and bottom 301 seals are perpendicular to a horizontal plane, then the wordings are oriented to be parallel to a horizontal plane. In one embodiment the package comprises a traditional pillow pouch. In another embodiment the package comprises a stand-up package.

Referring back to FIG. 3*a*, the top seal 302 comprises a notch 303. The notch 303 can comprise a variety of shapes including triangular, circular, etc. In the embodiment shown the notch 303 comprises a vertical slit. As can be seen the notch 303 is surrounded by intact seal 302. Put differently, the notch 303 does not extend to the top of the package. Instead, there is intact material above the notch 303. If there was not intact material above the notch 303 then the free top edges of the notch 303 could snag an object and undesirably initiate opening. Having the intact material above the notch 303 prevents these accidental openings.

The notch 303 can comprise a variety of sizes. In one embodiment the notch 303 is symmetrical whereas in another embodiment the notch is asymmetrical. In one embodiment, the notch 303 is fully surrounded by the top seal 302. If the notch 303 extended downward beyond the top seal 302 and into the front panel 309, then such a notch 303 could compromise the barrier protections offered by the seal 302. As such, the notch 303 is located so that it does not compromise the barrier protections offered by the seal. In one embodiment the notch 303 has a length of between about ¼ inch to about 1/16 inch. In one embodiment the notch 303 has a length of about ⅛ inch. One skilled in the art will understand that different lengths and shapes of the notch 303 will be suitable for different types and sizes of packages.

The notch 303 can be located anywhere along the top seal 302. It should be noted that the notch 303 can also be located on the bottom seal 301. In packages comprising a back seal 308, the notch 303 is not generally placed above the back seal 308 as tear initiation through a back seal 308 is often difficult. In one embodiment, the notch 303 is located a distance 305 from the centerline 306 of the package. The notch 303 can be located to the left, to the right, or even on the centerline 306 and be located at virtually any distance 305 from the centerline 306. In the embodiment depicted, the notch 303 is located to the right of the centerline 306 because most consumers are right handed. In one embodiment, the distance 305 from the notch 303 and the centerline 306 varies from about 0 inches to about 4 inches. In another embodiment, the distance 305 varies from about ¼ inch to about 1 inch, and in yet another embodiment the distance is about ¾ inch. As will be discussed in more detail, having a consistent distance 305 as measured from the centerline 306 offers many unexpected benefits. Because the distance is measured from the centerline 306 instead from the package right or left edge, the distance 305 can be consistent regardless of package size. If all packages, regardless of size, have a notch located a distance of, for example ¾ inch to the right of the centerline 306, then the same seal jaws can be used to produce the notches in dissimilar sized packages. If the notch 303 location were determined from the right edge of the package, then the notch location would be different for different sized packages. This would require a different seal jaw for each different package size. Thus, changing from a 4.5" wide package to a 7" wide package would necessitate changing the seal jaws. Changing seal jaws often takes in excess of two hours and results in significant down time. Further, the seal jaws are typically expensive. By locating a notch 303 a consistent location from the centerline 306, the same seal jaws can produce notches for a variety of sized bags. This reduces the need to change seal jaws for each differently sized bag, and reduces the need to maintain a variety of dissimilar seal jaws. The seal jaws are explained in detail below.

The package further comprises at least one score line 304. As depicted, the package comprises two score lines 304*a*, 304*b*. As used herein score lines encompasses lines which have been partially scored into the material, completely slit through the material, or perforated.

The score lines can be made with various types of technology, including laser scoring, slitting, perforating, or die cutting. Regardless of the type of scoring, the barrier properties of the container should not be destroyed. The barrier properties are essential in keeping oxygen and moisture from contacting and adversely affecting the product within the container. In one embodiment, only the outer layer of the film is scored. As such, the inner layer of the container is left intact and the barrier properties of the container are not adversely affected.

In laser scoring a laser scores the external layer of a package creating a line of weakness. When a package is torn, the tear propagates along the score lines 304. Having multiple score lines 304*a*, 304*b* presents multiple opportunities for propagating the tear. For example, if the tear line misses the upper-most score line 304*a*, then it still has the possibility of propagating along the lower score line 304*b*. In one embodiment only a single score line is utilized, while in other embodiments two or more score lines are utilized. In one embodiment the score lines are separated by about ⅛ inch to about ½ inch.

In one embodiment the score lines 304*a*, 304*b* are located below the notch 303 and extend to the left and to the right of the notch 303. As depicted the score lines 304 extend to the centerline 306 of the package. In other embodiments the score lines 304 extend to within about ½ inch to about 1/16 inch of the centerline 306. In one embodiment, the score lines 304 extend to about ⅛ inch to the right of the centerline 306.

As depicted the score lines 304*a*, 304*b* extend to and intersect the right edge of the package after forming. The location of the intersection 308 between the score lines and the edge of the package determines the overall slope of score lines. For example, all else being constant, if the distance 307 between the intersection 308 and the top of the upper seal 302 is great then the slope of the score lines will be greater than if the distance 307 is smaller. In one embodiment the distance 307 between the intersection 308 and the top of the upper seal 302 is between about 0.5 inch and about 5 inches, while in other embodiments the distance is from about 1 inch to about 3 inches. In another embodiment the distance 307 between the intersection 308 and the top of the upper seal 302 is between about 0.5 inch and about 2 inches, while in other embodiments the distance is from about 1 inch to about 1.25 inches. In one embodiment, the distance 307 between the intersection 308 and the upper seal 302 is greater than the maximum diameter of the contents in the container to aid in the retrieval of the contents. In one embodiment the object is to catch the tear just to the left of the root of the slope of the score lines and use the score to guide the cut around the bend of the curve. The slope of the score line and the distance 307 between the intersection 308 and the top of the upper seal 302 can be adjusted to determine the size and shape of the removable section.

Figure 1:
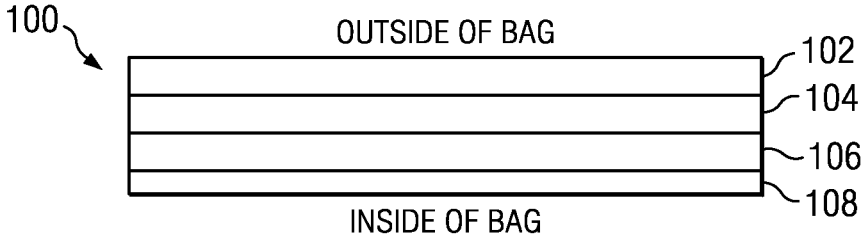
FIG. 1 (PRIOR ART)
FIG. 1 depicts a cross-section of an exemplary prior art packaging film.
Figure 2:
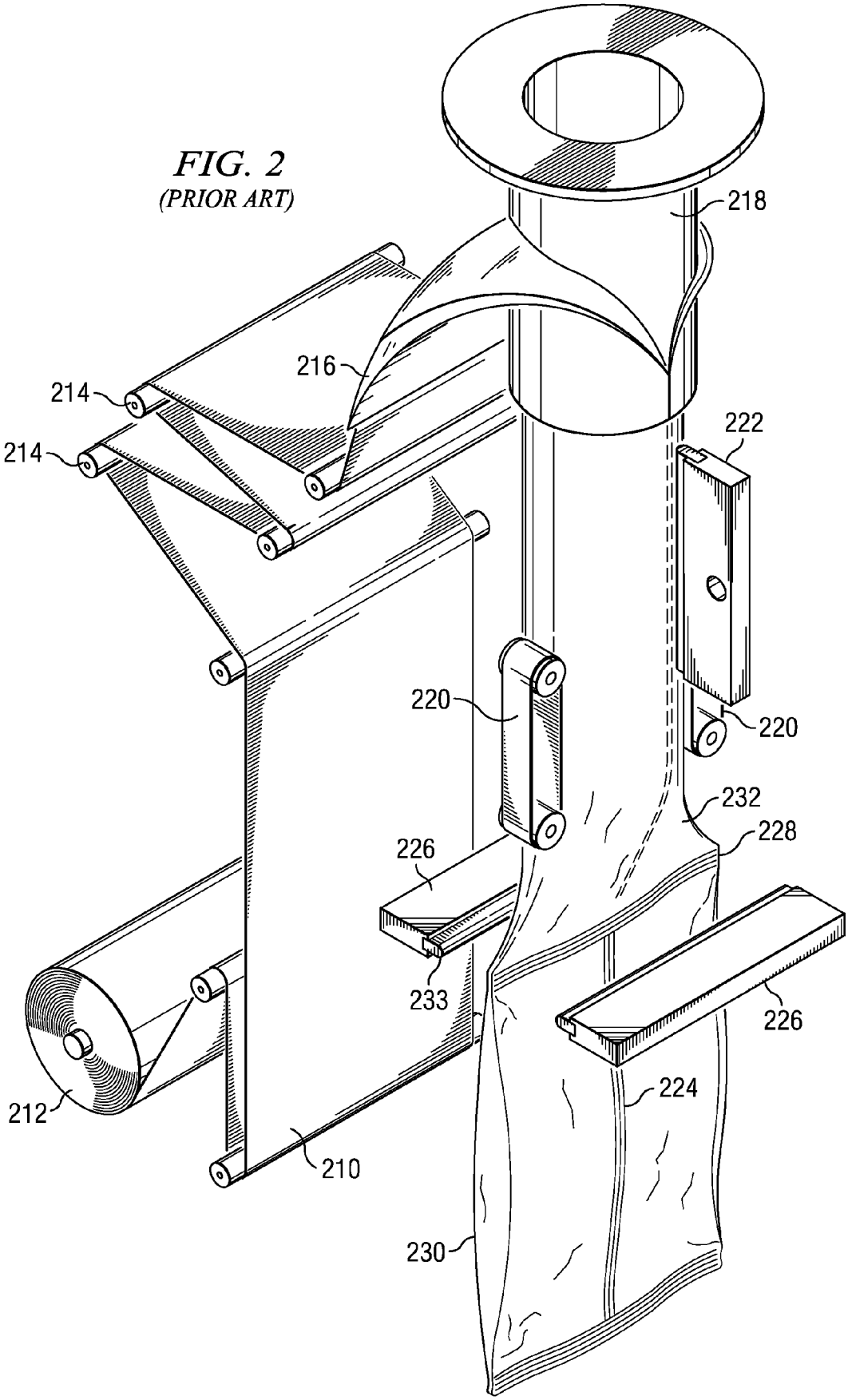
FIG. 2 (PRIOR ART)
FIG. 2 depicts a vertical form, fill, and seal machine that is known in the prior art.
Figure 4:
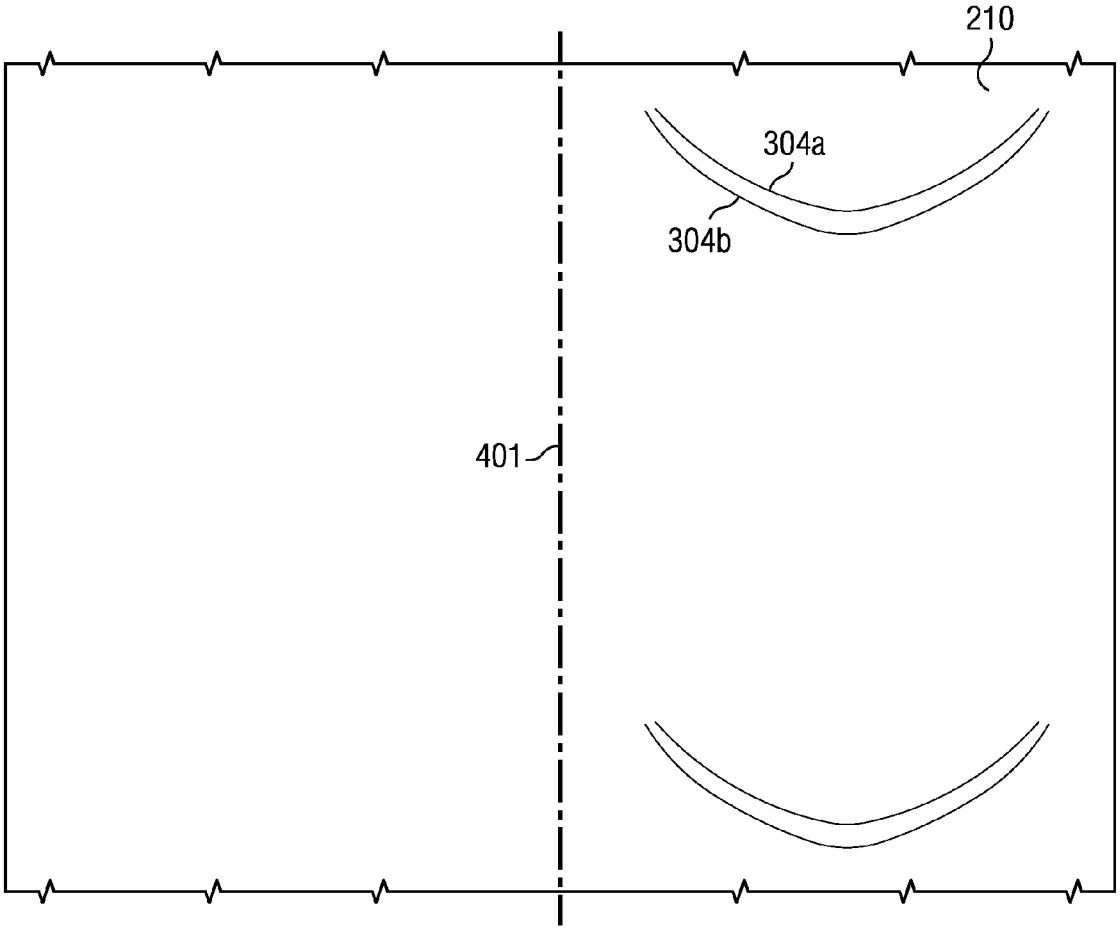
FIG. 4 depicts a top planar view of a film sheet in one embodiment.

In one embodiment the score lines are located only on the front panel of the package, but in other embodiments the score lines continue on the back panel. FIG. 4 depicts a top planar view of a packaging film 210 for one embodiment. In this process the score lines 304*a*, 304*b* can be formed either directly on the packaging film 210 or on a film layer prior to the film layer being laminated or otherwise attached with other layers for forming a packaging film 210. The packaging film 210 can be precut into segments, in one embodiment it is typically pulled from a roll of film as depicted in FIG. 2.

As depicted in FIG. 4, each of the score lines 304 is continuous. Further, in the embodiment depicted the score lines 304 are symmetrical along a vertical axis. The packaging film 210, once folded and formed in the fill and seal machine, forms the package shown in FIG. 3*a*. The resultant package comprises continuous score lines which initiate on the front panel of the package and continue on the back of the package.

In one embodiment the score line 304 comprises more than a straight horizontal line. Thus, in one embodiment the score line 304 comprises a line which comprises a curve. In one embodiment the score line 304 comprises a component in the x-axis and a component in the y-axis. Such an embodiment allows the score line to be processed on the former of a vertical form, fill, and seal machine without snapping along the score lines.

Figure 5:
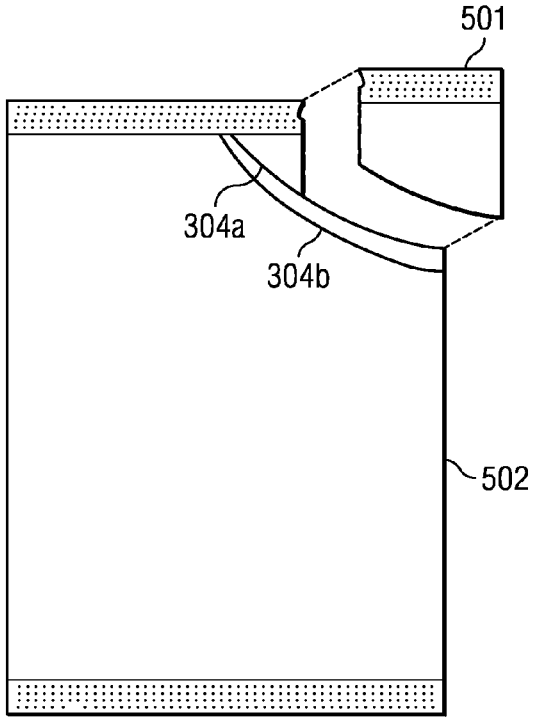
FIG. 5 depicts a top planar view of one embodiment of a package with the removable portion removed.

Referring back to FIG. 3*a*, to utilize the notch and score-lines described above, a consumer grips the top seal and pulls the top seal in opposite directions around the notch 303 to initiate a tear. The tear propagates downward in the direction of the applied force until it encounters a score line 304*a*. Because the score line 304*a* is a weakened line, the tear begins to propagate along the score line 304*a*. While the tear is propagating along the panel 309 of the package, the same tear is generally propagating along the score line 304*a* on the back 310 of the package. Once both tears intersect, a removable section is formed which allows the package content to be retrieved. FIG. 5 depicts a top planar view of one embodiment of a package with the removable portion 501 removed. The shape of the removable section 501 is defined by the location of the notch 303 and the score lines 304. If a narrow removable portion 501 is desired, then the notch 303 is generally placed close to the removable edge 502 as depicted. For example, as shown in FIG. 5 the notch 303 is located closer to the package's removable edge 502, the right edge. Such an arrangement allows for contents to be poured from the removable section 501. If a comparatively wider removable section 501 is desired, the notch 303 can be moved further to the left. Taken further, the notch 303 can be located in close proximity to the container's left edge. The score lines 304 would then extend from below the notch 303 to the package's right edge. Such an embodiment would allow for a wide removable section. Additionally, as previously stated, in one embodiment the slope of the score line 304 and/or the distance 307 between the intersection 308 and the top of the upper seal 302 can be adjusted to vary the size and shape of the removable section 501.

In one embodiment, the flexible film package is made by first feeding a first flexible film into a fill and seal machine. A fill and seal machine refers to a packaging machine which fills a package with product and seals a package. The product can comprise items such as snack foods, or the product can comprise other packages. In one embodiment the fill and seal machine comprises a form, fill, and seal machine. In one embodiment, the fill and seal machine comprises a vertical form, fill, and seal machine. In one embodiment the fill and seal machine comprises a horizontal form, fill, and seal machine. In one embodiment the fill and seal machine comprises pre-made pouch machine whereby the pouches are pre-made and the machine fills and seals the pouch. In one embodiment the pre-made pouch comprises a tube with one or more unsealed ends which are sealed after the pouch is filled. In one embodiment the fill and seal machine comprises an overwrapper. Accordingly, while one embodiment discusses a vertical form, fill, and seal machine, the invention is not so limited.

In one embodiment, the film comprises an outer layer comprising at least one score line. Next, the flexible film is formed into a tube. Thereafter the bottom of the tube is sealed to form a bottom seal on the resultant package. The package is then filled with product. Then, the top seal is formed by sealing the top of the resultant package. Simultaneously with forming the top seal, a notch is created in the first final package. The notch is formed a desired distance as measured from the centerline of the top seal. In one embodiment, after following the above stated steps for a 7 inch wide final package, the process is repeated for a 4.5 inch wide final package. The same steps are performed with the same set of seal jaws. In one embodiment, the distance from the notch to the centerline of the top seal will be about the same for both the 7 inch and the 4.5 inch packages.

In one embodiment the film comprises graphics, and the graphics are oriented on the film so that after the top seal is formed the graphics are readable when the top and bottom seals are oriented perpendicular to a horizontal plane. In another embodiment the film comprises graphics, and the graphics are oriented on the film so that after the top seal is formed the graphics are readable when the top and bottom seals are oriented parallel to a horizontal plane.

Figure 6A:
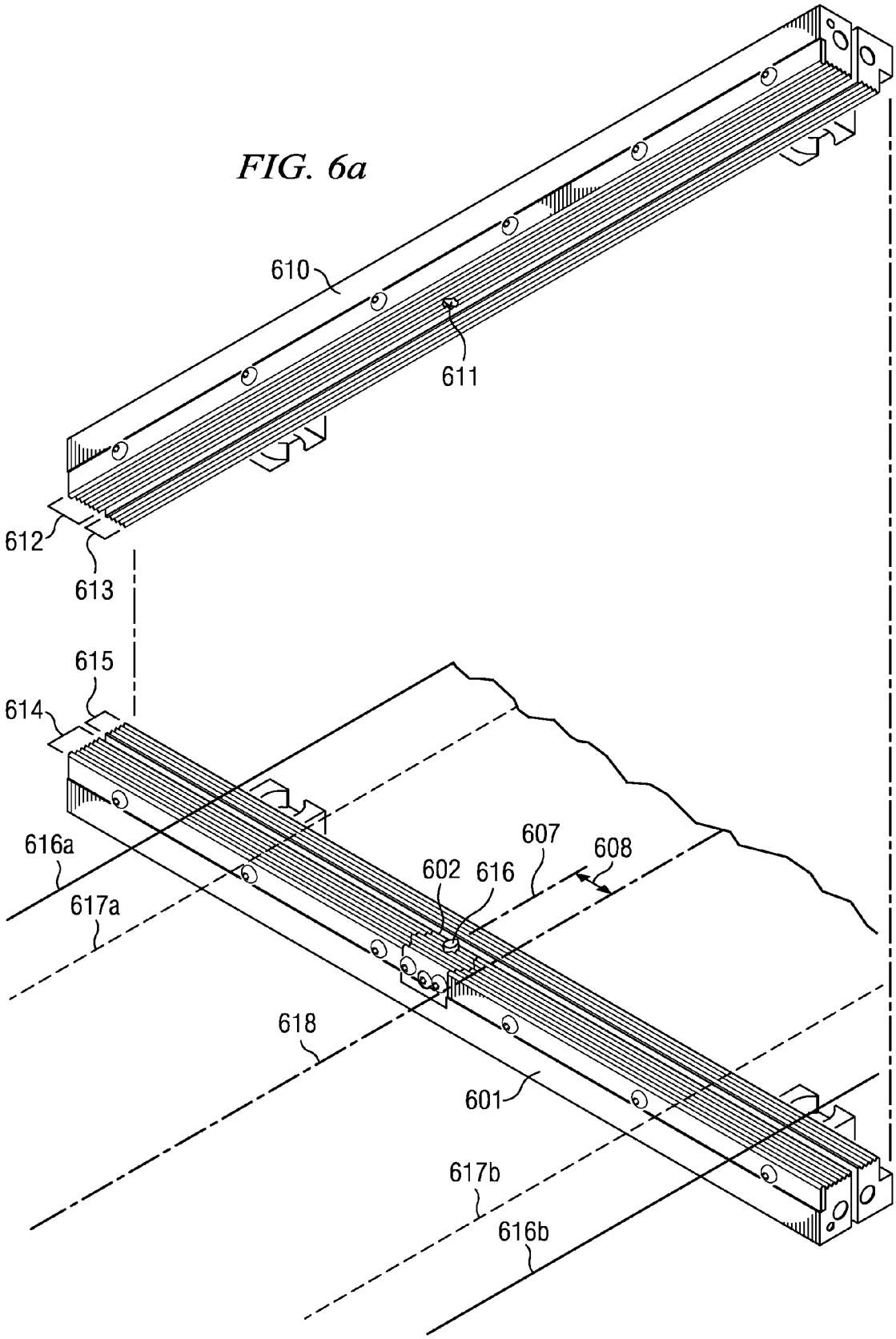
FIG. 6*a* is a perspective view of the front and back seal jaws in one embodiment.

The notch 303 can be formed in a variety of ways with a variety of seal jaws. One seal jaw for one embodiment is illustrated in FIG. 6*a*. FIG. 6*a* shows the back seal jaw 610 and the front seal jaw 601. The seal jaws shown in FIG. 6*a* are utilized to make both the top and bottom seal. The upper portion 613, 615 of the back 610 and front seal jaw 601 clamp to form the bottom seal. Thereafter the package is filled with product and pulled downward. Then, the lower portion 614, 612 of the back 610 and front seal jaw 601 clamp to form the top seal. In operation the back 610 and front seal jaws 601 simultaneously create the upper seal for a downstream package and a lower seal for an upstream package. A knife is then used to separate the formed and sealed downstream package from the partially sealed upstream package. While in one embodiment a single set of seal jaws creates both the top and bottom seals, in other embodiments a separate set of seal jaws will create the top and bottom seals.

As illustrated the front seal jaw 601 comprises a removable insert 602. While illustrated as being in the front seal jaw 601, the removable insert 602 may also be located in the back seal jaw 610. The insert 602, as depicted, is located in the lower portion 614 of the front seal jaw 601. The removable insert 602 comprises a blade pin 616, used for making a notch. A removable insert 602 comprising a blade pin 616 is referred to as a notch-making insert. The blade pin 616 can comprise a variety of shapes including triangular, flat, pyramidal, etc. In one embodiment the blade pin 616 comprises a flat blade. In one embodiment the blade pin 616 is symmetrical across a vertical axis whereas in other embodiments the blade pin 616 is asymmetrical across a vertical axis. In one embodiment the blade pin 616 comprises a pyramidal shape. In one embodiment an asymmetrical pyramidal shape is used. In such an embodiment the asymmetrical shape helps to minimize wear on the blade pin 616 and helps the blade pin 616 maintain strength. In one embodiment the pyramidal shape prolongs the life of the blade pin 616 and prevents breakage that is sometimes associated with a flat blade. In one embodiment the blade pin 616 is raised a distance of about 1/16 inch to about 1/4 inch above the surrounding sealing pattern. The blade pin 616 can be located anywhere along the front seal jaw 601. The location of the blade pin 616 will determine the location of the notch in the final package. In one embodiment the location 607 of the blade pin 616 is located a distance 608 from the jaw centerline 618 of the front seal jaw 601. The distance 608 from the centerline 618 of the front seal jaw 601 can vary from about 0 inches to about 2 inches, while in another embodiment the distance 608 is about 0.75 inches.

Figure 8:
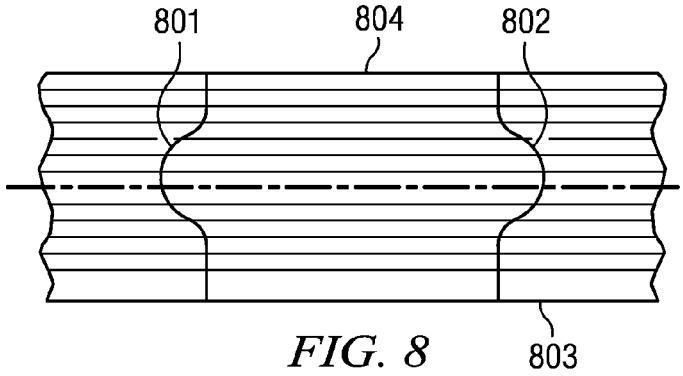
FIG. 8 depicts a top planar view of a uniform insert for one embodiment.

The removable insert 602 can comprise a variety of shapes and sizes. In one embodiment the removable section 602 is shaped so that it can be installed in only one orientation. Such a shape prevents the removable insert 602 from being installed backwards which could damage the seal jaws. In one embodiment the removable insert 602 is misshapen to prevent channel leakage. Put differently, the left and right vertical sides are non-linear. In one embodiment the left and right sides are curved. In one embodiment, the left and right sides provide a torturous path for channel formation. In one embodiment the torturous path is asymmetrical. The torturous path increases the length of a potential leak channel, thus increasing resistance to gaseous movements. In one embodiment the torturous path doubles the length of a potential leak channel. Such a path minimizes channel leakage across the seal. To illustrate, while the insert 602 is sized to fit snugly against the surrounding seal jaw 601, there are small gaps between the insert 602 and the surrounding seal jaw 601. Such gaps lead to the possibility that a proper seal will not be formed in the area above the gaps. If the insert 602 had straight sides, the resulting gap would also be straight. As such, if a proper seal did not form above the gap, there is a possibility that a channel of unsealed film layer may extend between both sides of the seal. Such a channel could compromise the barrier characteristics of the package. However by giving the insert non-linear sides then the resulting gap will also be non-linear. A non-linear gap decreases the likelihood of the formation of a channel that extends between both sides of the seal. Consequently, an insert with non-linear sides helps reduce channel leakage. The non-linear sides are also illustrated in FIG. 8. FIG. 8 depicts a top planar view of a uniform insert for one embodiment. As depicted the uniform insert comprises non-linear sides.

Figure 6B:
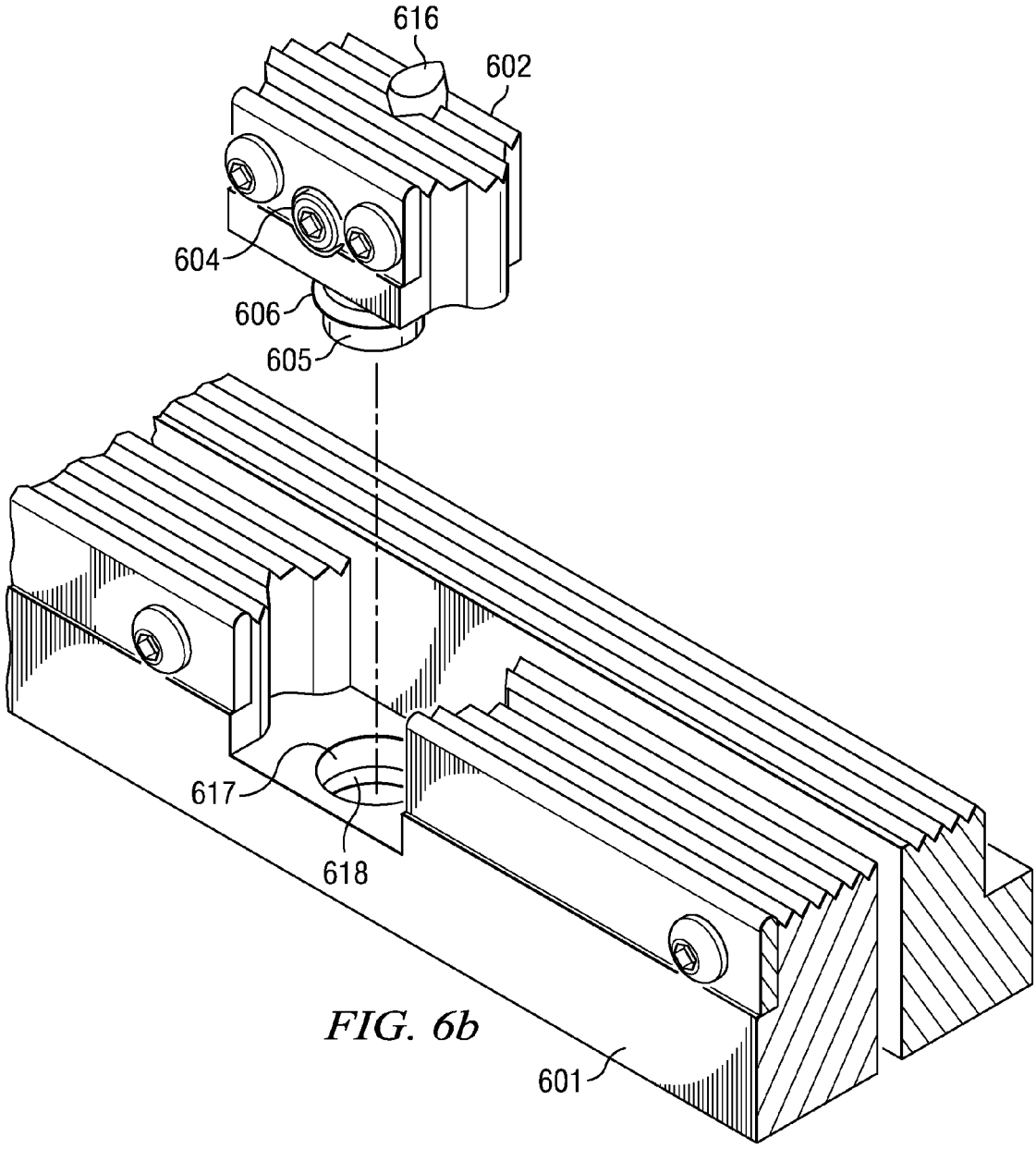
FIG. 6*b* is an enlarged perspective view of the embodiment of FIG. 6*a* with the removable insert removed.

FIG. 6*b* is a magnified version of the back seal jaw with the removable insert 602 removed. As can be seen, in one embodiment, the removable insert 602 comprises a locking device 604, which is coupled to the blade pin 616 and locks the blade pin 616 in place. The locking device 604 allows the height of the blade pin 616 to be adjusted and or replaced. Accordingly, if a blade pin 616 is damaged, only the blade pin 616 need be replaced. To remove the blade pin 616, the locking device 604 is manipulated to allow removal of the blade pin 616. The height of the blade pin 616 can then be adjusted. In one embodiment, the removable insert 602 comprises a hole in which the blade pin 616 is located. In one such embodiment, the hole extends to the bottom of the removable insert 602. Accordingly, the blade pin 616 level can be adjusted by applying pressure on the blade pin 616 from above and/or below as required. The locking device 604 can comprise screw, a lock, etc. In one embodiment the locking device 604 applies pressure upon the blade pin 616 to secure the blade pin 616 in place. Those skilled in the art will understand the various devices and methods which can secure the removable blade pin 616 in place. Further, while the blade pin 616 is shown as being adjustable, in other embodiments the blade pin 616 is not adjustable and is instead fixed.

In one embodiment, the removable insert 602 also comprises a base stem 605 which provides additional support. The base stem 605 also ensures that the removable insert 602 is at the correct height. As depicted, the base stem 605 comprises a gasket ring 606. The gasket ring 606, when the removable insert 602 is installed, fits into the gasket channel 618 of the base hole 617 located on the front seal jaw 601. The compression forces experienced by the gasket ring 606 as it engages the gasket channel 618 helps secure the removable insert 602 in its installed position. Further, the gasket ring 606 helps to ensure the insert 602 is installed in the correct location and at the correct height.

In one embodiment the base stem 605 and the gasket ring 606 ensure the removable insert 602 remains in place during operation. In other embodiments the removable insert 602 may further comprise additional locking devices which would lock the removable insert 602 in its secured position.

Referring back to FIG. 6*a*, the front seal jaw 601, including the installed removable section 602, operates as previously described by clamping with the back seal jaw 610 onto the packaging film to make an upper seal and a lower seal. The blade pin 616 of the removable section 602 mates with the blade gap 611 located on the back seal jaw 610. The depth of the blade gap 611 must be deep enough to accommodate the blade pin 616. Further, the blade gap 611 must be located to correspond with the blade pin 616. When the back seal jaw 610 and front seal jaw 601 are mated, the upper and lower seals are formed from the packaging film. The blade pin 616 pierces the film layers and creates a notch. As previously described, the size and shape of the notch is determined by the size and shape of the blade pin 616. The notch provides an initiation point for the consumer to tear down.

Figure 7:
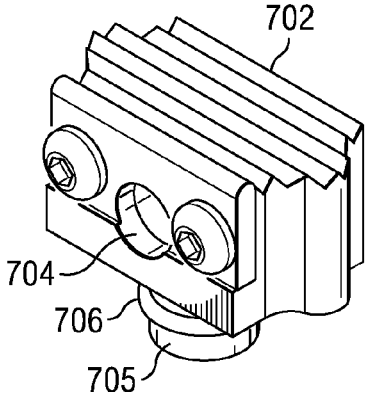
FIG. 7 depicts a top perspective view of a uniform insert for one embodiment.

As described, FIG. 6*a* illustrates an embodiment wherein the removable insert is a notch-making insert, as the insert comprises a blade pin. FIG. 7 illustrates an embodiment wherein the removable insert does not comprise a blade pin. Such a removable insert is referred to as a uniform removable insert 702 because it does not comprise a blade pin. Rather, the uniform insert 702 comprises the same sealing surface as the rest of the back seal jaw 610. Thus, in one embodiment the goal of the uniform insert 702 is to function as if the front seal jaw 601 was a continuous seal jaw that did not have an insert. The uniform insert 702 still comprises a base stem 705 and a ring gasket 706. The uniform removable insert 702 without a blade pin is the same shape and size as the notch-making removable insert 602. Accordingly the uniform removable insert 702 is interchangeable with the notch-making removable insert 602.

When it is desired to produce packages comprising a notch, a notch-making removable insert 602 is installed into the front seal jaw 601. Installation comprises the steps of aligning the removable insert into position and placing the base stem into the base hole. The blade pin 616 height can be adjusted before or after aligning and placing the base stem into the base hole. The seal jaws then operate as previously described with the blade pin 616 mating with the blade gap 611 on the front seal jaw 601 creating a notch. When it is desired to produce a package without a notch, the notch-making removable insert 602 is replaced with the uniform removable insert 702. Thus, the locking device is unlocked and the notch-making removable insert 602 is removed. The uniform removable insert 702 is then installed as previously described. Now, when the seal jaws operate as previously described there is no blade pin to pierce the films. Consequently, a notch is not produced. The blade gap 611 does not interfere with the sealing of the package, and a suitable seal is formed. Thus, to change from producing a package with a notch to a package without a notch, the back seal jaw 610 need not be altered.

In one embodiment, the removal of one insert and the installation of a different insert requires about two minutes. This is considerably faster than the process for replacing the entire jaw set which typically takes about 2 hours or more. Such a process required time for the entire seal jaw assembly to cool before removable could begin. Thereafter the entire seal jaw would have to be removed from the jaw assembly. As stated, this process typically took about 2 hours resulting in significant down time. With the process of the instant invention, the removable insert can be removed and replaced without removing the entire jaw assembly. The significant time saved results in increased throughput and profit. Furthermore, if a blade pin 616 becomes damaged, then only the removable insert must be replaced as opposed to the entire jaw assembly being replaced. In one embodiment only the blade pin 616 is removed and replaced. Because seal jaws are expensive, the removable insert allows for decreased capital expenditure. Taken further, a different sized or shaped notch may be desirable for a package. Rather than replacing an entire seal jaw, a removable insert comprising the desired blade pin can be installed.

As previously discussed, in one embodiment the notch is located a consistent distance 305 from the centerline 306 for all packages regardless of size. In such embodiments, the location of the removable insert is also consistent. Accordingly, utilizing a seal jaw with a removable insert located in a consistent location eliminates the need to change seal jaws when changing bag sizes. As such, downtime is significantly reduced.

In one embodiment the jaw assembly comprises a first seal jaw comprising a blade gap, and a second seal jaw comprising a removable insert. The removable insert comprises a blade pin, and the blade pin mates with the blade gap of the first seal jaw. To create a notch a first tube is fed into the jaw assembly. FIG. 6*a* illustrates the alignment of a film web approaching the front seal jaw 601. The film web, which in one embodiment comprises a tube, comprises a left edge 616*a* and a right edge 616*b*. The left edge 616*a* and right edge 616*b* are aligned so that the resulting notch, formed by blade pin 616, is located a desired distance from the film centerline 618. As depicted the film centerline 618 aligns with the jaw centerline 618. In other embodiments the film centerline 618 will not align with the jaw centerline. FIG. 6*a* also illustrates the alignment of a more narrow film web approaching the front seal jaw 601 comprising a left edge 617*a* and a right edge 617*b*. The left edge 617*a* and the right edge 617*b* are aligned so that the resulting notch is located about the same desired distance from the film centerline 618 as in the wide film layer. This illustrates that the alignment of the left and/or right edges does not have to remain constant and can be changed to ensure that the desired distance from the centerline to the location of the notch is consistently maintained despite varying the dimensions of material to be sealed.

After the material is fed to the seal jaws, the first and second seal jaws are mated to form the first seal. Simultaneously while sealing, a notch is created by mating the blade gap with the blade pin. As previously described, the film edges are aligned so as to result in the notch being located a desired distance as measured from the centerline of the seal. The steps may be repeated for a second tube which is wider or narrower than the first tube. In such embodiments the film edges are aligned to ensure that the distance between the notch and the centerline is maintained. As such, there is no need to adjust the seal jaw. Specifically, there is no need to adjust the location of the blade pin 616. The method allows the creation of a notch for adaptable film widths in a single jaw assembly.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

1. A package comprising a flexible film, said package comprising:
   a bottom seal;
   a top seal;
   a front panel defined as between said bottom and top seals, wherein said front panel has a right side and a left side;
   a back panel contiguous with said front panel and defined as between said bottom and top seals;
   wherein said front and back panels each comprise at least two layers of film, an inner and an outer layer;
   wherein said top seal comprises a notch, wherein said notch does not extend to the top of said top seal;
   wherein said outer layer comprises at least one score line, wherein said at least one score line is located on said front panel below said notch.
2. The package according to any preceding clause, wherein said outer layer comprises oriented film.
3. The package according to any preceding clause, wherein said notch does not compromise the barrier properties of the package.
4. The package according to any preceding clause, wherein said notch is located to the right of the centerline of said top seal.
5. The package according to any preceding clause, wherein said notch is located to the left of the centerline of said top seal.
6. The package according to any preceding clause, wherein said notch is located a distance of about ¼ inch to about one inch from the centerline of said top seal.

7. The package according to any preceding clause, wherein said at least one score line comprises laser scoring.
8. The package according to any preceding clause, wherein said at least one score line extends to the left and to the right of said notch.
9. The package according to any preceding clause, wherein said at least one score line extends to the centerline of said package.
10. The package according to any preceding clause, wherein said at least one score line extends from said front panel to said back panel.
11. The package according to clause 10, wherein said at least one score line is continuous.
12. The package according to clause 10, wherein said at least one score line intersects a right edge of said front panel at a distance of between about ½ inch to about 3 inches below said top seal.
13. The package according to any preceding clause, comprising at least two score lines.
14. The package according to clause 13, wherein said at least two score lines are separated by a distance of between about ⅛ inch to about ½ inch.
15. The package according to any preceding clause, wherein said front panel comprises graphics, and wherein said graphics are readable when said top and said bottom seals are parallel to a horizontal plane.
16. The package according to any preceding clause, wherein said front panel comprises graphics, and wherein said graphics are readable when said top and said bottom seals are perpendicular to a horizontal plane.
17. An improved jaw assembly for sealing a package, said assembly comprising:
a first seal jaw comprising a blade gap;
a second seal jaw comprising:
a removable insert.
18. The assembly according to clause 17, wherein said removable insert further comprises a blade pin.
19. The assembly according to clauses 17-18, wherein said removable insert further comprises a locking device, wherein said locking device is coupled to said blade pin.
20. The assembly according to clause 19, wherein said blade pin is vertically adjustable relative to said insert.
21. The assembly according to clauses 17-20, wherein said removable insert comprises a base stem and a gasket ring.
22. The assembly according to clause 21, wherein said bottom seal comprises a stem hole, said stem hole sized to mate with said base stem, and wherein said second seal jaw further comprises a gasket channel located on said stem hole.
23. The assembly according to clauses 17-22, wherein said removable insert is a uniform insert.
24. The assembly according to clauses 17-23, wherein said first seal jaw comprises an upper portion and a lower portion, wherein said second seal jaw comprises an upper portion and a lower portion, wherein said removable insert is located on said lower portion of said second seal jaw, wherein said upper portions of said first and second seal jaws mate to form a bottom seal, and wherein said lower portions of said first and second seal jaws mate to form a top seal.
25. The assembly according to clauses 17-24, wherein said blade gap is located about ¾ inch from the centerline on said first seal jaw.
26. The assembly according to clauses 17-25, wherein said insert comprises non-linear sides.
27. The assembly according to clauses 17-26, wherein said insert fits within said second seal jaw in only one orientation.
28. A method for making a flexible film package said method comprising the steps of:
a) feeding a first flexible film into a fill and seal machine, wherein said film web comprises an outer layer comprising at least one score line;
b) forming said first flexible film web into a tube;
c) sealing said first flexible film web at the bottom of said tube, thereby forming a bottom seal on a first resultant package;
d) filling said first resultant package with product;
e) sealing the top of said first resultant package, thereby forming a top seal; and
f) creating a notch in said top seal, thereby forming a first final package, wherein said notch is formed a desired distance from the centerline of said top seal;
wherein said sealing step and said creating step occur simultaneously.
29. The method according to clause 28, wherein said feeding of step a) comprises feeding a layer of oriented polypropylene.
30. The method according to clauses 28-29, wherein said feeding step a) comprises feeding said flexible film into a vertical form, fill, and seal machine.
31. The method according to clauses 28-30, wherein said creating step comprises creating a notch above said at least one score line.
32. The method according to clauses 28-31, wherein said creating step comprises creating a notch to the right of the centerline of said top seal.
33. The method according to clauses 28-32, wherein said creating step comprises creating a notch, wherein said notch does not extend to the top of said top seal.
34. The method according to clauses 28-33, wherein said creating step said desired distance is about ¼ inch to about one inch from the centerline of said top seal.
35. The method according to clauses 28-34, wherein said feeding step comprises feeding a first flexible film comprising graphics, and wherein said graphics are oriented during said feeding step so that after the top seal is formed in step f) the graphics are readable when the top and bottom seals are oriented parallel to a horizontal plane.
36. The method according to clauses 28-35, wherein said feeding step comprises feeding a first flexible film comprising graphics, and wherein said graphics are oriented during said feeding step so that after the top seal is formed in step f) the graphics are readable when the top and bottom seals are oriented perpendicular to a horizontal plane.
37. The method according to clauses 28-36, wherein said feeding of step a) comprises feeding into a horizontal form, fill, and seal machine.
38. The method according to clauses 28-37, further comprising:
g) feeding a second flexible film into a fill and seal machine, wherein said second film web comprises an outer layer comprising at least one score line;
h) forming said second flexible film web into a tube;
i) sealing said second flexible film web at the bottom of said tube with a pair of seal jaws, thereby forming a bottom seal on a second resultant package;
j) filling said second resultant package with product;
k) sealing at the top of said second resultant package with a pair of seal jaws, thereby forming a top seal; and
l) creating a notch in said top seal, thereby forming a second final package, wherein the distance between the centerline of said top seal and said notch is about the same for both said second final package and said first final package.

39. The method according to clauses 28-38, wherein said feeding step g) comprises feeding a second flexible film layer such that said second final package is wider than said first final package.

40. The method according to clauses 28-39, wherein said feeding step g) comprises feeding a second flexible film layer such that said first final package is wider than said second final package.

41. The method according to clauses 28-40, wherein said pair of seal jaws remains unaltered for both said first and said second flexible film layers.

42. A method for making a notch for adaptable film widths in a jaw assembly, said jaw assembly comprising:
a first seal jaw comprising a blade gap;
a second seal jaw comprising:
a removable insert comprising a blade pin, wherein said blade pin mates with said blade gap;
said method comprising the steps of:
a) feeding a first tube comprising a left edge and a right edge into said jaw assembly;
b) sealing said tube by mating said first seal jaw with said second seal jaw, thereby forming a seal;
c) creating a notch in said tube by mating said blade gap with said blade pin;
wherein said feeding step comprises aligning said at least one of said edges so that said notch is located a desired distance from the centerline of said seal.

43. The method according to clause 42, further comprising the step of repeating steps a-c wherein during said feeding step a second tube is fed into said jaw assembly, wherein said second tube is wider than said first tube, and wherein the jaw assembly is unaltered.

44. The method according to clauses 42-43, further comprising the step of repeating steps a-c wherein during said feeding step a second tube is fed into said jaw assembly, wherein said first tube is wider than said first tube, and wherein the jaw assembly is unaltered.

45. The method according to clauses 42-44 wherein said feeding step comprises feeding a first tube, wherein said first tube comprises a pre-made pouch.

46. An easy open bag and method for making the same. A film is fed into a jaw assembly comprising a first seal jaw comprising a blade gap and a second seal jaw comprising a removable insert. The removable insert comprises a blade pin. When the first and second seal jaws are mated, a notch is formed. The film also comprises a score line in the outer layer. Upon tearing the notch the tear propagates along the score line. Thus, the package can be easily opened by initiating a tear at a tear notch.

What is claimed is:

1. A package comprising a flexible film web, said package comprising:
a bottom seal;
a top seal;
a front panel defined as between said bottom and top seals;
a back panel contiguous with said front panel and defined as between said bottom and top seals;
wherein said front and back panels each comprise at least two layers of film, an inner layer and an outer layer, the inner layer providing a barrier to protect contents of the package;
wherein said top seal comprises a notch and a seal lower edge, the lower edge extending laterally in a straight line across the entire front and back panels and below the notch, wherein said notch does not extend to a top of said top seal;
wherein said outer layer comprises a pair of spaced apart score lines, wherein said score lines are each located below said notch and below a lower edge of said top seal, and each score line extends from a first end on the front panel, across a portion of the front panel, and across a portion of the back panel, to a second end on the back panel, the first and second ends of each score line laterally spaced from the centerline of the package.

2. The package of claim 1 wherein said outer layer comprises oriented film.

3. The package of claim 1 wherein each one of said pair of spaced apart score lines comprises an arcuate shape between the first and second ends.

4. The package of claim 1 wherein said pair of score lines comprises laser scored lines.

5. The package of claim 1 wherein each one of said pair of score lines is continuous.

6. The package of claim 1 wherein the first end of at least one score line intersects a side edge of the package at a distance of between about 0.5 inch to about 3 inches below said top seal.

7. The package of claim 1 comprising at least two score lines.

8. The package of claim 1 wherein said pair of spaced apart score lines are separated by a distance of between about 0.125 inch to about 0.5 inch.

9. The package of claim 1 wherein said front panel comprises graphics, and wherein said graphics are readable when said top and said bottom seals are parallel to a horizontal plane.

10. The package of claim 1 wherein said front panel comprises graphics, and wherein said graphics are readable when said top and said bottom seals are perpendicular to a horizontal plane.

11. The package of claim 1, wherein terminal ends of the each of the pair of spaced apart score lines is laterally spaced about 0.0625 to about 0.5 inches from the centerline.

12. A package comprising a flexible film web, said package comprising:
a front panel comprising at least two film layers;
a back panel contiguous with the front panel, the back panel comprising at least two film layers and sealed to the front panel by a bottom seal and a top seal, the top seal having a seal lower edge, the lower edge extending laterally in a straight line across the entire front and back panels;
a notch in the top seal, the notch not extending to the top edge of the top seal and the notch laterally spaced away from a vertical centerline of the package; and
a pair of spaced apart score lines, the score lines spaced away from the notch and the top seal and extending continuously below the notch and below a lower edge of the top seal from the front panel to the back panel to within about 0.0625 to about 0.5 inches from the centerline, the score lines each comprising a weakened line along which a tear will propagate when initiated at the notch by pulling in a downward direction;
wherein the package has barrier properties.

13. A package having barrier properties, said package comprising:
a flexible film web comprising at least two film layers, the web folded to form a front panel and a back panel, the back panel sealed to the front panel by a bottom seal and a top seal, the top seal having a seal lower edge, the lower edge extending laterally in a straight line across the entire front and back panels, the at least two film layers forming an inner layer and an outer layer when the web is folded, the inner layer providing a barrier layer;

a notch in the top seal, the notch spaced away from a centerline of the package and not extending to the top edge of the top seal; and a pair of spaced apart score lines extending at least in the outer layer, the score lines spaced away from the notch and located below a lower edge of the top seal and extending continuously below the notch from the front panel to the back panel to terminate within about 0.0625 to about 0.5 inches from the centerline, the score lines each comprising a weakened line along which a tear will propagate when initiated at the notch by pulling in a downward direction.

* * * * *